US010099224B2

(12) United States Patent
Peterson et al.

(10) Patent No.: US 10,099,224 B2
(45) Date of Patent: Oct. 16, 2018

(54) MATERIAL REDUCING DEVICE

(71) Applicant: Astec Industries, Inc., Chattanooga, TN (US)

(72) Inventors: Arnold Neil Peterson, Eugene, OR (US); Glenn Ford Bittrolf, Springfield, OR (US); Bradly Michael Deuerling, Eugene, OR (US)

(73) Assignee: Astec Industries, Inc., Chattanooga, TN (US)

( * ) Notice: Subject to any disclaimer, the term of this patent is extended or adjusted under 35 U.S.C. 154(b) by 1222 days.

(21) Appl. No.: 14/216,629

(22) Filed: Mar. 17, 2014

(65) Prior Publication Data

US 2014/0217214 A1 Aug. 7, 2014

Related U.S. Application Data

(63) Continuation-in-part of application No. 13/724,063, filed on Dec. 21, 2012.

(Continued)

(51) Int. Cl.
*B02C 13/26* (2006.01)
*B02C 18/18* (2006.01)

(Continued)

(52) U.S. Cl.
CPC ..... *B02C 18/18* (2013.01); *B02C 18/145* (2013.01); *B02C 2018/162* (2013.01); *B02C 2018/188* (2013.01); *B02C 2023/165* (2013.01)

(58) Field of Classification Search
CPC . B02C 18/18; B02C 18/145; B02C 2018/162; B02C 2018/188; B02C 2023/165

(Continued)

(56) References Cited

U.S. PATENT DOCUMENTS 2,919,863 A * 1/1960 Lejeune ..... D21D 1/22 241/186.3
3,473,742 A * 10/1969 Montgomery ..... B02C 18/146 241/190

(Continued)

OTHER PUBLICATIONS

International Search Report and Written Opinion of International Searching Authority for related PCT Application—Application No. PCT/US12/71267, filed Dec. 21, 2012.

*Primary Examiner* — Anthony Stashick
*Assistant Examiner* — Onekki Jolly
(74) *Attorney, Agent, or Firm* — Chambliss, Bahner & Stophel, P.C.

(57) ABSTRACT

A material reducing machine includes a rotor assembly having a plurality of short cutting tools and a plurality of long cutting tools. The short cutting tools are arranged in rows which extend across the length of the rotor assembly, which rows are spaced around the periphery of the rotor assembly. Each of the short cutting tools has a cutting bit with a leading edge that is spaced outwardly from the periphery of the rotor assembly by a short cutter distance. The long cutting tools are also arranged in rows which extend across the length of the rotor assembly, which rows are spaced around the periphery of the rotor assembly. Each of the long cutting tools has a cutting bit with a leading edge that is spaced outwardly from the periphery of the rotor assembly by a long cutter distance that is greater than the short cutter distance of each of the short cutting tools. A breaker assembly includes a plurality of shear blocks, each of which is spaced so as to be aligned with a short cutting tool.

20 Claims, 15 Drawing Sheets

Related U.S. Application Data

(60) Provisional application No. 61/630,953, filed on Dec. 22, 2011, provisional application No. 61/802,968, filed on Mar. 18, 2013.

(51) Int. Cl.
*B02C 18/14* (2006.01)
*B02C 23/16* (2006.01)
*B02C 18/16* (2006.01)

(58) Field of Classification Search
USPC ..... 241/32, 73, 82, 88.4, 185.5, 186.35, 241/189.1, 242
See application file for complete search history.

(56) References Cited

U.S. PATENT DOCUMENTS 3,549,093 A * 12/1970 Wilhelm ..... B27L 11/02 241/154
3,642,214 A * 2/1972 Blackwell, Jr. ..... B02C 18/184 241/191
3,662,963 A 5/1972 McClure
3,973,735 A 8/1976 Ito et al.
4,239,160 A * 12/1980 Hawkins ..... B02C 18/186 241/222
5,269,355 A * 12/1993 Bowen ..... A01G 23/067 144/218
5,273,218 A * 12/1993 Burns ..... B02C 18/146 241/189.1
5,320,292 A * 6/1994 Smith ..... B02C 13/2804 144/229
5,472,147 A * 12/1995 Doppstadt ..... B02C 13/09 241/101.74
5,628,467 A 5/1997 Graveman
5,743,472 A * 4/1998 Williams, Jr. ..... B02C 18/146 241/239
5,887,808 A 3/1999 Lucas
5,947,395 A * 9/1999 Peterson ..... B02C 18/145 241/223
5,950,945 A * 9/1999 Schaller ..... B02C 13/28 241/189.1
6,089,480 A * 7/2000 Rawlings ..... B02C 13/2804 241/189.1
6,227,469 B1 * 5/2001 Daniels, Jr. ..... B02C 13/06 241/186.3
6,536,322 B1 * 3/2003 Butler ..... B23D 61/06 83/840
6,648,253 B1 * 11/2003 Adolph ..... B02C 13/282 241/189.1
6,742,732 B1 * 6/2004 Hundt ..... B02C 18/225 241/186.3
6,880,774 B2 * 4/2005 Bardos ..... B02C 13/06 241/189.1
7,004,413 B2 * 2/2006 Langlois ..... B02C 18/184 241/242
7,055,770 B2 * 6/2006 Bardos ..... B02C 13/06 241/189.1
7,090,157 B2 8/2006 Peterson et al.
7,232,084 B2 6/2007 Peterson et al.
7,527,212 B2 * 5/2009 Kitaguchi ..... B02C 13/286 241/186.35
7,584,921 B1 * 9/2009 Bennington ..... A01G 23/093 241/294
7,681,816 B2 * 3/2010 Tanaka ..... B02C 13/284 241/101.74
7,832,670 B2 * 11/2010 Peterson ..... B02C 13/286 241/186.35
2007/0284465 A1 * 12/2007 Kitaguchi ..... B02C 13/286 241/185.5
2009/0256017 A1 * 10/2009 Firestone ..... B01F 7/00458 241/188.1
2010/0252670 A1 10/2010 Kitaguchi

* cited by examiner

MATERIAL REDUCING DEVICE

CROSS-REFERENCE TO RELATED APPLICATION

This application is a continuation-in-part of U.S. patent application Ser. No. 13/724,063, which was filed on Dec. 21, 2012, and which claims the benefit of U.S. Provisional Patent Application No. 61/630,953, filed on Dec. 22, 2011. This application also claims the benefit of U.S. Provisional Patent Application No. 61/802,968 which was filed on Mar. 18, 2013.

FIELD OF THE INVENTION

The present invention relates generally to machines for use in reducing various materials, especially those obtained in a structural demolition process so that such materials can be more conveniently transported from a demolition site. More particularly, this invention is particularly useful in reducing railroad ties containing or contaminated with metal tie plates and spikes.

BACKGROUND OF THE INVENTION

Material reducing machines are well-known for use in connection with the demolition of a house or other structure. Such machines typically include a conveyor for moving debris such as wood, siding, roofing materials and even appliances such as water heaters toward a rotating drum having tools thereon which is contained within a housing having an anvil bar located in close proximity to the free ends of the rotating drum tools. The tools of the rotating drum carry material into contact with the anvil bar where it is broken into smaller pieces. Most commonly, a plurality of screen sections are located adjacent to and downstream of the anvil bar so that further rotation of the drum causes partially reduced material to be further reduced by successive impacts of the tools of the rotating drum until it will pass through the apertures in one or another of the screens.

Known material-reducing machines may not be suitable for use in reducing all types of materials, particularly if there is the possibility that an object which cannot be reduced, such as a large dense metal component or fragment, or a railroad tie that contains metal tie plates and spikes, can be introduced into the machine. Some machines include shear pins that will break when an object that cannot be reduced is introduced, thereby allowing a portion of the machine housing to pivot or otherwise move so as to enlarge the opening through which the object can pass. In machines which include a shear pin, operator intervention is required when a pin shears to get the machine back into operating order.

In addition, known material-reducing machines may not efficiently reduce fibrous materials like roofing shingles, because it may require multiple impacts of such materials against the anvil to provide acceptable reduction. Furthermore, some of the prior art machines may fail to produce uniformly shaped smaller pieces. Some types of materials tend to break in elongated shapes in the prior art machines, and these elongated shapes may be difficult to handle or transport, and may therefore be generally undesirable. When these elongated shapes are able to pass through the screen sections of the prior art machines along with more uniformly sized particles, they may contaminate the resulting product with pieces of an undesirable size. Finally, prior art machines are not readily adaptable to processing different types of materials.

Notes on Construction

The use of the terms "a", "an", "the" and similar terms in the context of describing the invention are to be construed to cover both the singular and the plural, unless otherwise indicated herein or clearly contradicted by context. The terms "comprising", "having", "including" and "containing" are to be construed as open-ended terms (i.e., meaning "including, but not limited to,") unless otherwise noted. The terms "substantially", "generally" and other words of degree are relative modifiers intended to indicate permissible variation from the characteristic so modified. The use of such terms in describing a physical or functional characteristic of the invention is not intended to limit such characteristic to the absolute value which the term modifies, but rather to provide an approximation of the value of such physical or functional characteristic. All methods described herein can be performed in any suitable order unless otherwise specified herein or clearly indicated by context.

The use of any and all examples or exemplary language (e.g., "such as" and "preferably") herein is intended merely to better illuminate the invention and the preferred embodiments thereof, and not to place a limitation on the scope of the invention. Nothing in the specification should be construed as indicating any element as essential to the practice of the invention unless so stated with specificity.

Various terms are specifically defined herein. These terms are to be given their broadest possible construction consistent with such definitions, as follows:

The term "material reducing machine" refers to a machine that is adapted to cut, chop, shred, break or otherwise reduce material into smaller pieces.

The terms "upper", "top" and similar terms, when used in reference to a relative position or direction on or with respect to a material reducing machine, or a component or portion of such a machine, refer to a relative position or direction that is farther away from the surface on which the material reducing machine is placed for operation.

The terms "lower", "bottom" and similar terms, when used in reference to a relative position or direction on or with respect to a material reducing machine, or a component or portion of such a machine, refer to a relative position or direction that is nearer the surface on which the material reducing machine is placed for operation.

The term "horizontal", when used in reference to a plane that includes the axis of rotation of the rotor assembly of a material reducing machine, refers to a plane that is generally parallel to the surface on which the material reducing machine is placed for operation.

The term "front end" and similar terms refer to the end of a material reducing machine, or a component or portion of such a machine, which is nearest the point at which material to be reduced is introduced into the machine.

The terms "forward", "in front of", and similar terms, as used herein to describe a relative position or direction on or in connection with a material reducing machine or a component of such a machine, refer to a relative position or direction towards the front end of the machine.

The terms "back end", "rear end" and similar terms refer to the end of a material reducing machine, or a component or portion of such a machine, which is farther from the front end of the machine, component or portion thereof.

The terms "rearward", "behind", and similar terms, as used herein to describe a relative position or direction on or in connection with a material reducing machine or a component of such a machine, refer to a relative position or direction towards the rear end of the machine.

The term "leading", as used herein in connection with a cutting tool that is mounted on the rotor assembly of a material reducing machine, or in connection with a shear block or breaker block that is a part of the breaker assembly of a material reducing machine, refers to the outer edge of the cutting bit of the cutting tool that approaches the shear block or breaker block of the adjacent breaker assembly as the rotor assembly rotates, or to the outer edge or surface of the shear block or breaker block of the breaker assembly that is first encountered by material carried by the cutting tools that are mounted on the adjacent rotor as the rotor assembly rotates.

The term "long", as used herein to describe cutting tools that are mounted along the length of the rotor assembly, refers to the cutting tools having a longer outward radial projection from the axis of rotation than the "short" cutting tools.

The term "short", as used herein to describe cutting tools that are mounted along the length of the rotor assembly, refers to the cutting tools having a shorter outward radial projection from the axis of rotation than the "long" cutting tools.

The term "downstream", as used herein to describe a relative position on or in connection with a material reducing machine, refers to a relative position in the direction of the movement of material to be reduced through the machine.

The term "upstream", as used herein to describe a relative position on or in connection with a material reducing machine, refers to a relative position in a direction that is opposite to the direction of the movement of material to be reduced through the machine.

SUMMARY OF THE INVENTION

The invention comprises a material reducing machine having a frame and a rotor assembly which is mounted for rotation with respect to the frame. Mounted on the rotor assembly are a plurality of cutting tools, each of which includes a cutting bit thereon. The cutting tools are arranged in rows that extend across the length of the rotor assembly (i.e., across the width of the frame of the machine), and rows of cutting tools are spaced around the periphery of the rotor assembly. Some of the cutting tools are long cutting tools and some are short cutting tools. The machine also includes a breaker assembly that is located adjacent to the rotor assembly. The breaker assembly is located adjacent to the rotor assembly and includes a back plate and a plurality of shear blocks. In a preferred embodiment of the invention, the breaker assembly includes a plurality of breaker blocks. The shear blocks extend towards the rotor assembly a greater distance than the optional breaker blocks, and the cutting tools on the rotor assembly and the shear blocks and breaker blocks are arranged so that the long cutting tools are aligned with the breaker blocks and the short cutting tools are aligned with the shear blocks.

The shear blocks may be configured differently in order to accommodate different materials being processed or different operating conditions. For example, the shear blocks may have a beveled leading edge, an angled leading edge or a flat leading edge. The shear blocks may have an outer surface that is interrupted by notches or grooves, or the outer surface may be smooth. In some embodiments of the invention, the shear blocks have a leading surface that comprises a slide angle of greater than 100°, when measured from a horizontal plane that includes the axis of rotation of the rotor assembly. In other embodiments of the invention, the shear blocks have a leading surface that comprises a slip angle that is within the range of 80°-100°, when measured from a horizontal plane that includes the axis of rotation of the rotor assembly. In still other embodiments of the invention, the shear blocks have a leading surface that comprises an anvil angle that is within the range of 50°-80°, when measured from a horizontal plane that includes the axis of rotation of the rotor assembly. In yet other embodiments of the invention, the shear blocks have a leading surface that comprises a catch angle that is within the range of 40°-50°, when measured from a horizontal plane that includes the axis of rotation of the rotor assembly. In still other embodiments of the invention, each of the shear blocks has an outer surface that is curved to describe an arc that is generally parallel to the arc described by the leading edge of the short cutting tool with which it is aligned. In the preferred embodiments of the invention, the shear blocks are mounted on the back plate of the breaker assembly, which allows an operator to maintain a plurality of back plates that can be easily and quickly interchanged, depending on the types of materials being processed.

In addition, the breaker blocks of the preferred embodiment may be configured differently in order to accommodate different materials being processed or different operating conditions. In some embodiments of the invention, the breaker assembly includes breaker blocks having an outer surface and a leading edge that forms a right angle or an approximate right angle with the outer surface. In other embodiments of the invention, the breaker blocks have a leading surface that gradually increases to a point of maximum outward projection from the back plate and a trailing surface that gradually decreases from the point of maximum outward projection. In some embodiments of the invention, an anvil is mounted upstream of the breaker assembly, and in other embodiments, there is no anvil. In some embodiments of the invention, the anvil is a part of the breaker assembly, and the breaker blocks are attached to the anvil.

In a preferred embodiment of the invention, a resistance and biasing mechanism is provided between the frame and the pivot shaft on which the pivot arm and the bypass arm carrying the breaker assembly are mounted. In this embodiment of the invention, a resistance and biasing mechanism is also provided between the frame and the bypass arm.

In order to facilitate an understanding of the invention, the preferred embodiments of the invention are illustrated in the drawings, and a detailed description thereof follows. It is not intended, however, that the invention be limited to the particular embodiments described or to use in connection with the apparatus illustrated herein. Various modifications and alternative embodiments such as would ordinarily occur to one skilled in the art to which the invention relates are also contemplated and included within the scope of the invention described and claimed herein.

Advantages of Preferred Embodiments of the Invention

Among the advantages of a preferred embodiment of the invention is that it provides a material reducing machine that breaks and reduces materials into uniformly sized pieces. Still another advantage of a preferred embodiment of the invention is that it provides such a machine which operates with greater efficiency than prior art devices. Still another advantage of a preferred embodiment of the invention is that it provides such a machine that can process materials that are incapable of reduction without damaging the machine or stopping its operation. Yet another advantage of a preferred embodiment of the invention is that it provides a material reducing machine that may be readily modified, by changing the breaker assembly, to allow for processing of different types of materials and for operation within a wide range of speeds. Another advantage of a preferred embodiment of the invention is that it allows the material reducing machine to operate effectively at slower speeds, reducing fuel consumption, wear and noise levels. Other advantages and features of this invention will become apparent from an examination of the drawings and the ensuing description.

BRIEF DESCRIPTION OF THE DRAWINGS

The presently preferred embodiments of the invention are illustrated in the accompanying drawing drawings, in which.

DESCRIPTION OF THE PREFERRED EMBODIMENTS OF THE INVENTION

Figure 1:
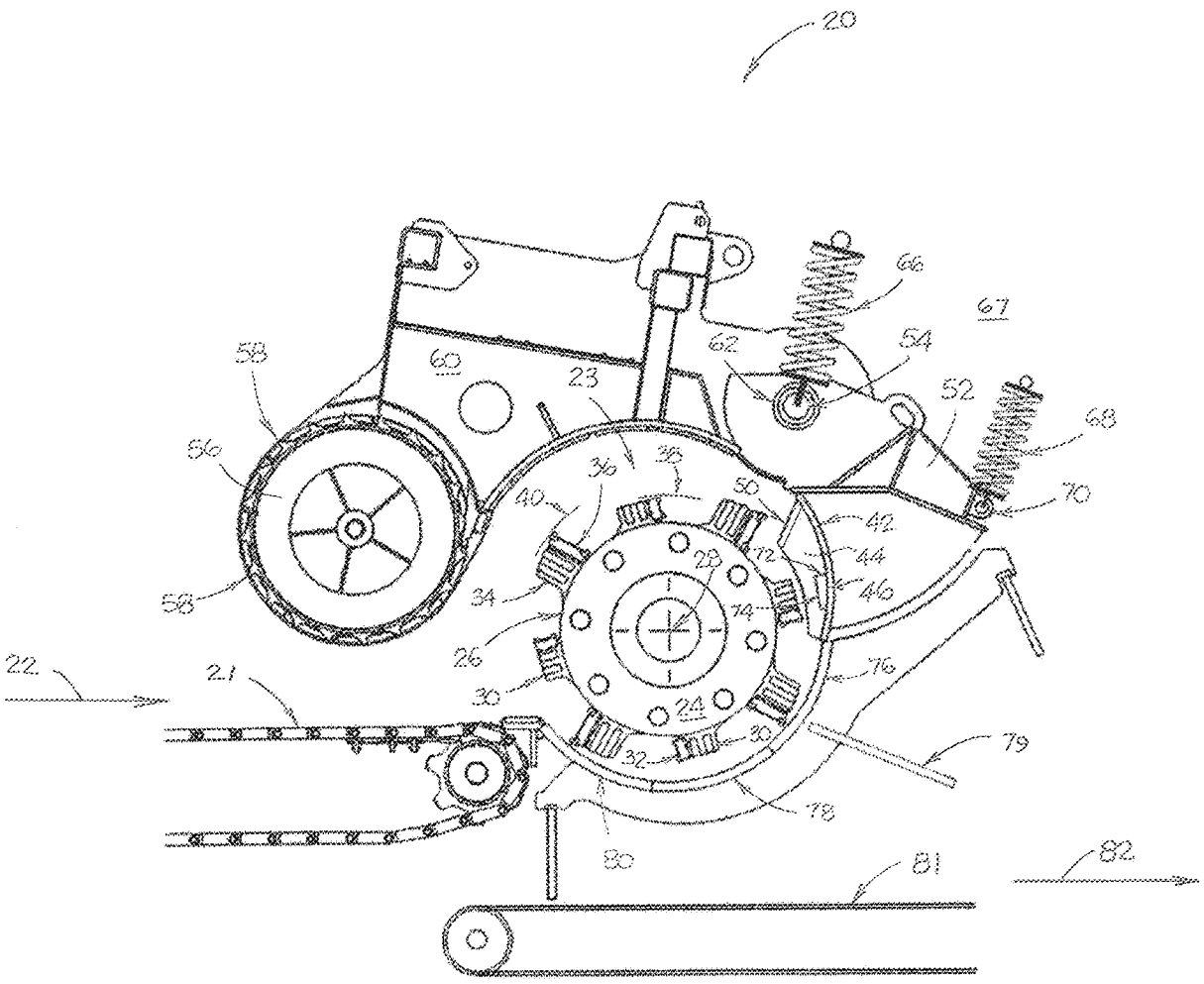
FIG. 1 is a schematic illustration of a material reducing machine having a breaker assembly including shear blocks comprising an anvil angle and breaker blocks having an outer surface and a leading edge that forms a right angle with the outer surface.

A first embodiment of the invention is illustrated in FIG. 1. As shown therein, material reducing machine 20 includes a generally horizontal material input device such as input conveyor 21. Conveyor 21 is adapted to move material to be reduced in the direction indicated by arrow 22 toward rotor assembly 23. In other embodiments of the invention (not shown in the drawings), the material input device may comprise a chute, and it may be placed with respect to the rotor assembly other than a generally horizontal orientation.

Rotor assembly 23 comprises a plurality of generally circular rotor plates, one of which, plate 24, is shown in FIG. 1. Because of its generally circular rotor plates, rotor assembly has a generally cylindrical periphery 26. Rotor assembly 23 is adapted to rotate in a clockwise rotational direction, as shown in FIG. 1, about its axis of rotation 28. Rotor assembly 23 comprises a plurality of short cutting tools comprising short tool holders 30 with cutting bits 32 mounted thereon and a plurality of long cutting tools comprising long tool holders 34 with cutting bits 36 mounted thereon. The cutting tools are arranged in rows that extend across the length of the rotor assembly (i.e., across the width of the frame of the machine), and rows of cutting tools are spaced around the periphery of the rotor assembly. Because of the location of input conveyor 21 with respect to rotor assembly 23 and the direction of rotation of rotor assembly 23, the cutting tools on rotor assembly 23 will make initial contact with material being introduced by the input conveyor in an upward (or up-cutting) direction. Consequently, as the rotor assembly is rotated, the tools will carry material from conveyor 21 upwardly and into engagement with a breaker assembly that is located adjacent to the rotor assembly. The leading edges of cutting bits 32 of the short cutting tools mounted on rotor assembly 23 define an arc that is spaced outwardly from periphery 26 by a short cutter distance. A portion 38 of this arc is shown in FIG. 1. Similarly, the leading edges of cutting bits 36 of the long cutting tools mounted on rotor assembly 23 define an arc that is spaced outwardly from periphery 26 by a long cutter distance which is greater than the short cutter distance. A portion 40 of this arc is also shown in FIG. 1. As shown in FIG. 1, it is preferred that the short cutting tools be arranged in rows that are parallel to axis of rotation 28, which rows extend all the way across the length of the rotor assembly. Similarly, it is preferred that the long cutting tools be arranged in rows that are parallel to the axis of rotation, which rows extend all the way across the length of the rotor assembly. It is also preferred that alternating rows of short cutting tools and long cutting tools be spaced equally around the periphery of the rotor assembly, so that each row of long cutting tools is adjacent a row of short cutting tools.

Figure 2:
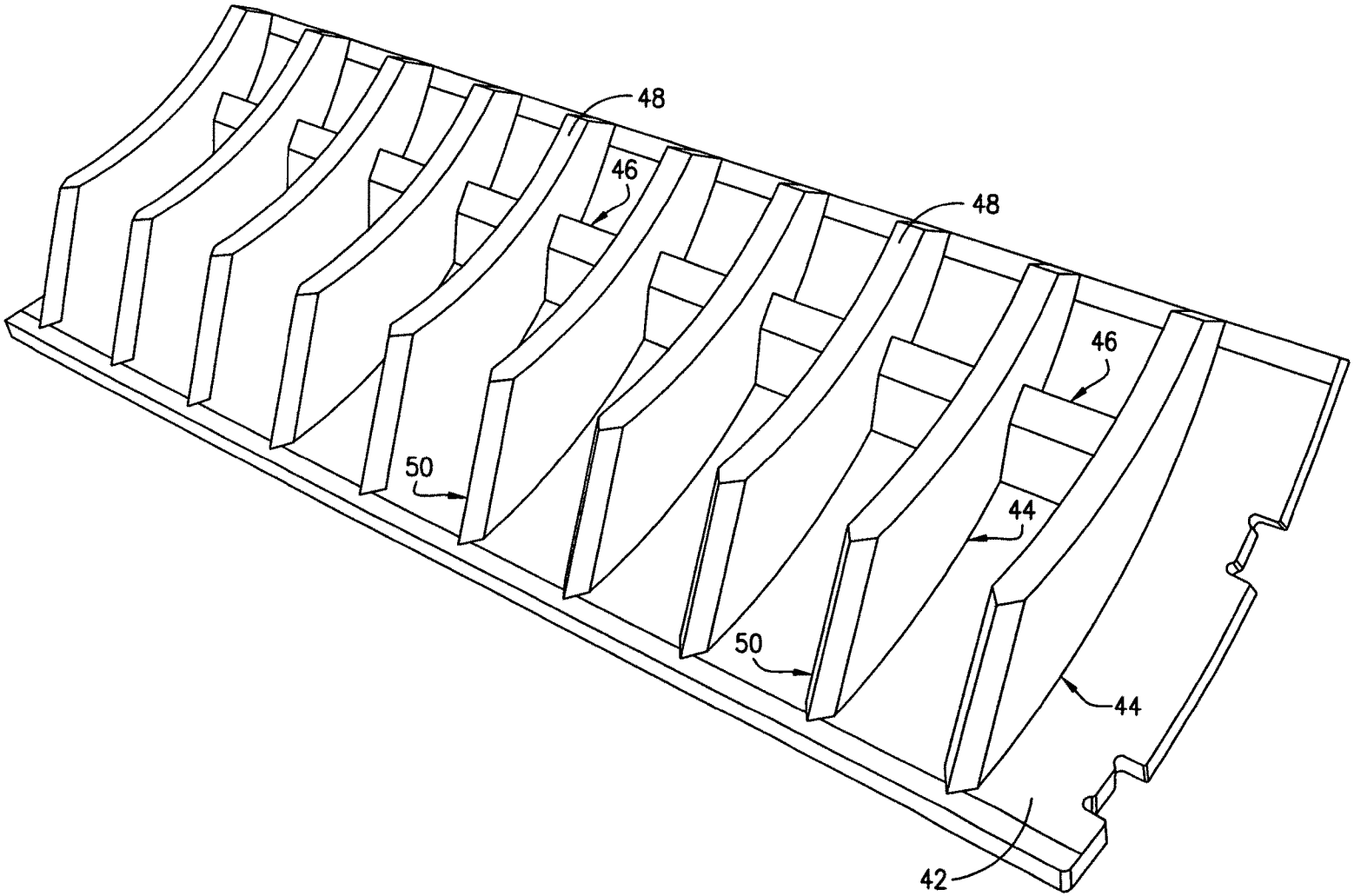
FIG. 2 is a perspective view of the breaker assembly shown in FIG. 1.

Material reducing machine 20 also includes a breaker assembly that is located adjacent to the rotor assembly. The breaker assembly includes a curved back plate 42 with a plurality of shear blocks 44 and breaker blocks 46 arranged across the width of the machine on the side of back plate 42 adjacent to rotor assembly 23. In some embodiments of the invention, such as, for example, the embodiment shown in FIGS. 19A and 19B, the back plate includes a plurality of apertures through which reduced material may pass. The shear blocks extend from the back plate towards the rotor assembly a greater distance than the breaker blocks, and the cutting tools on the rotor assembly and the shear blocks and breaker blocks on the back plate are arranged so that the long cutting tools are aligned with breaker blocks 46 and the short cutting tools are aligned with shear blocks 44. Furthermore, it is also preferred that the cutting tools of the rotor assembly and the shear blocks and breaker blocks of the breaker assembly are arranged so that at least one short cutting tool 30 passes over a shear block 44 with which it is aligned, and at least one long cutting tool 34 passes between a pair of adjacent shear blocks 44 and over the breaker block 46 with which it is aligned. More particularly, as shown in FIGS. 1 and 2, it is preferred that the short cutting tools and the long cutting tools are spaced along the length of the rotor assembly, and the shear blocks and the breaker blocks are spaced along the back plate in such a manner that all of the short cutting tools pass over the curved outer surfaces 48 of shear blocks 44, and the long cutting tools pass between adjacent shear blocks 44 and over the breaker blocks 46. The leading edges 50 of shear blocks 44 are beveled, as best shown in FIG. 2. Back plate 42 is a part of bypass arm 52, which is adapted to pivot about pivot axis 54 when non-crushable material encounters the breaker assembly.

Figure 3:
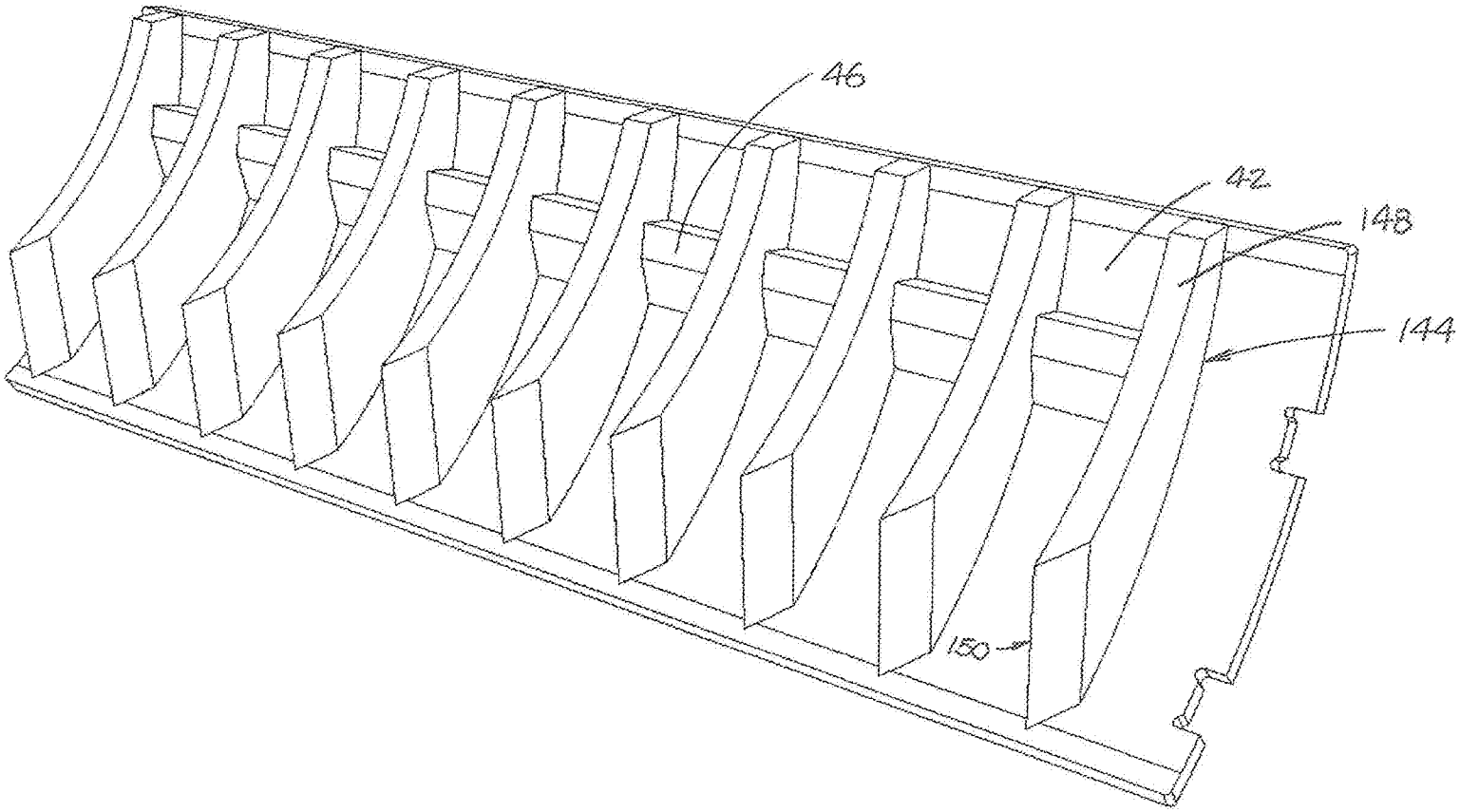
FIG. 3 is a perspective view of a first alternative embodiment of the breaker assembly of the material reducing machine illustrated in FIG. 1.
Figure 4:
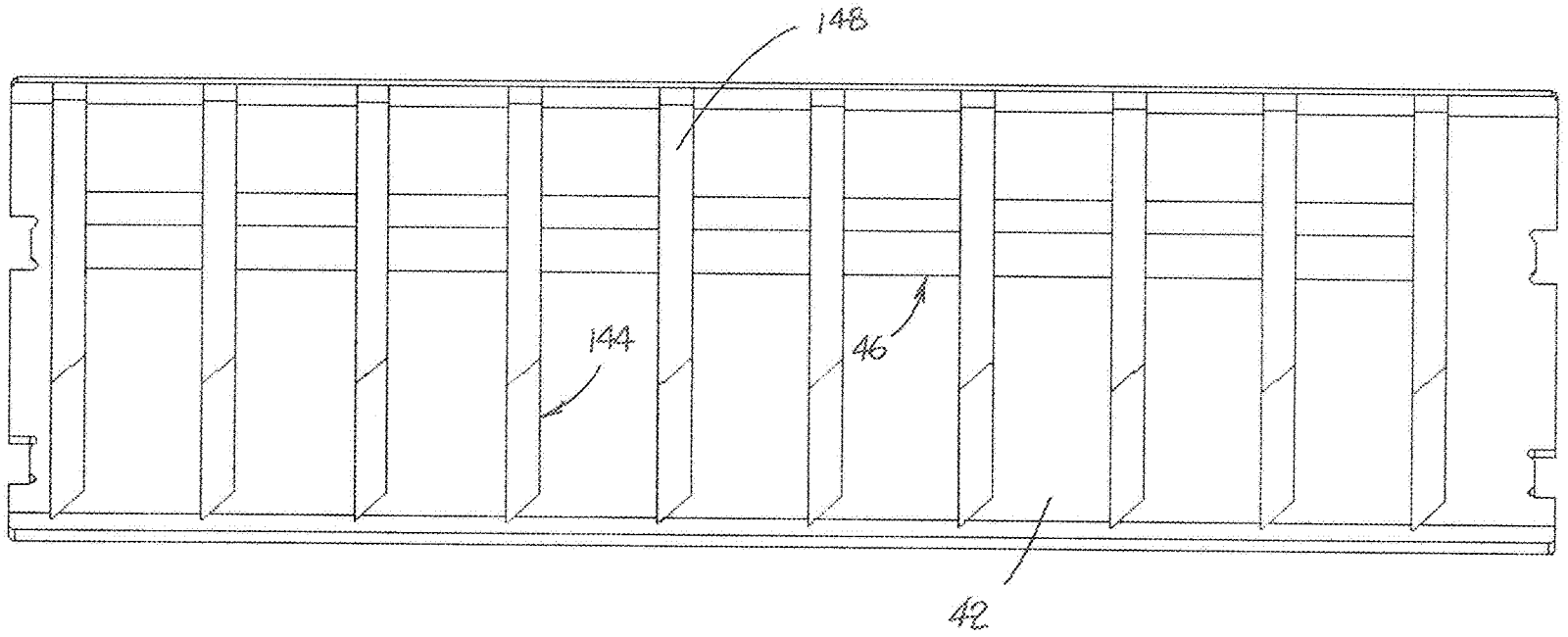
FIG. 4 is a top view of the embodiment of the breaker assembly of the material reducing machine illustrated in FIG. 3.

FIGS. 3 and 4 illustrate a second embodiment of the breaker assembly. As shown therein, the breaker assembly includes curved back plate 42 with a plurality of shear blocks 144 and breaker blocks 46 arranged across the width of the machine on the side of back plate 42 that would be adjacent to rotor assembly 23 if this breaker assembly were substituted for the one shown in FIGS. 1 and 2. In that event, shear blocks 144 would extend from back plate 42 towards the rotor assembly a greater distance than breaker blocks 46, and the cutting tools on the rotor assembly and the shear blocks and breaker blocks on the back plate would be arranged so that the long cutting tools would be aligned with breaker blocks 46 and the short cutting tools would be aligned with shear blocks 144. In this embodiment of the invention, the short cutting tools would pass over the curved outer surfaces 148 of shear blocks 144, and the long cutting tools would pass between adjacent shear blocks 144. The leading edges 150 of shear blocks 144 are angled.

Figure 5:
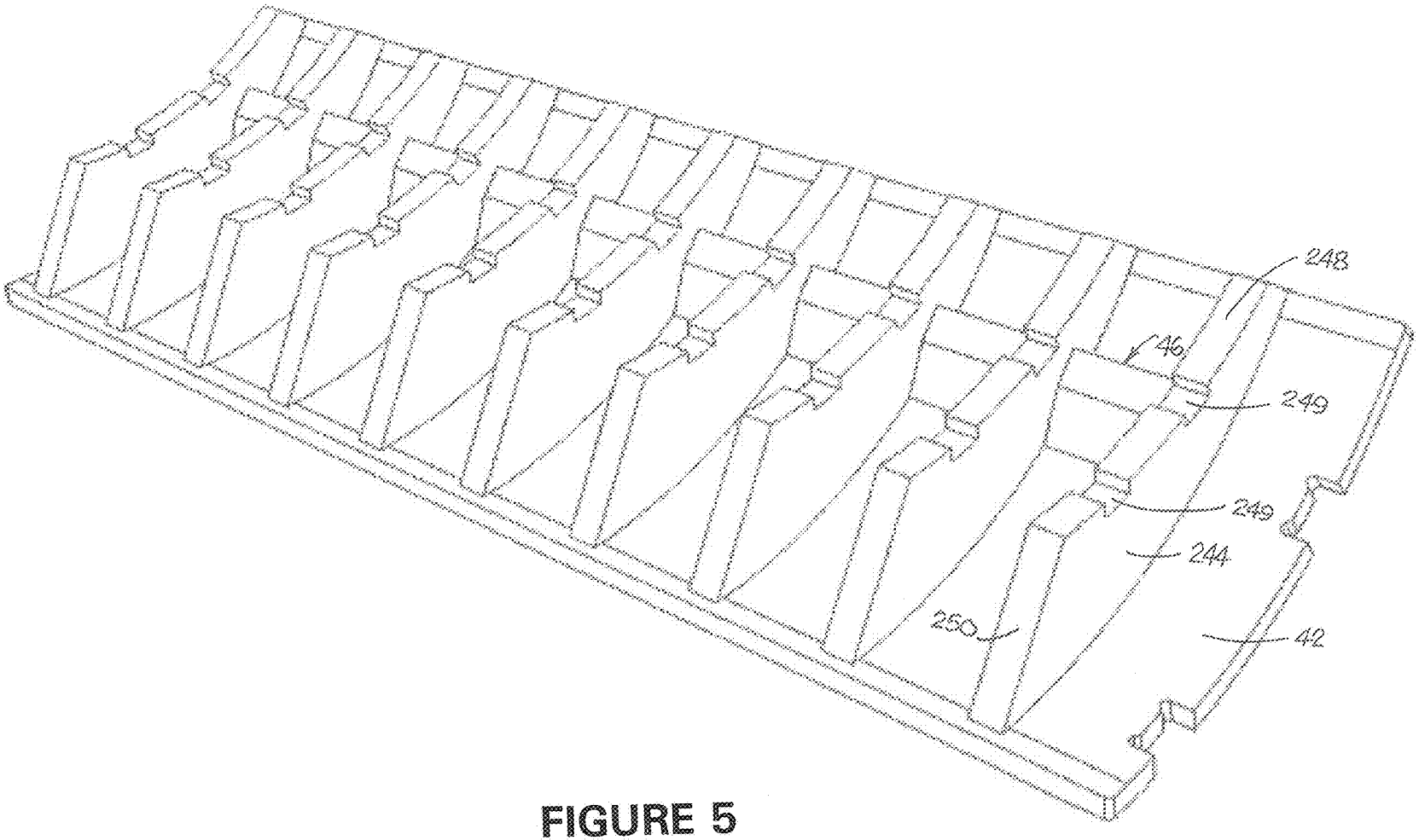
FIG. 5 is a perspective view of a second alternative embodiment of the breaker assembly of the material reducing machine illustrated in FIG. 1.

A third embodiment of the breaker assembly is illustrated in FIG. 5. As shown therein, the breaker assembly includes curved back plate 42 with a plurality of shear blocks 244 and breaker blocks 46 arranged across the width of the machine on the side of back plate 42 that would be adjacent to rotor assembly 23 if this breaker assembly were substituted for the one shown in FIGS. 1 and 2. In that event, shear blocks 244 would extend from back plate 42 towards the rotor a greater distance than breaker blocks 46, and the cutting tools on the rotor and the shear blocks and breaker blocks on the back plate would be arranged so that the long cutting tools would be aligned with breaker blocks 46 and the short cutting tools would be aligned with shear blocks 244. In this embodiment of the invention, the short cutting tools would pass over the curved outer surfaces 248 of shear blocks 244, which surfaces include a plurality of notches 249. The long cutting tools would pass between adjacent shear blocks 244. As shown in FIG. 5, the leading edges 250 of shear blocks 244 are flat.

Material reducing machine 20 includes compression roller 56 having ribs 58. Compression roller 56 is mounted on pivot arm 60, which is mounted for rotation on pivot shaft 54. Bypass arm 52 is also mounted for rotation on pivot shaft 54 in front of pivot arm 60 (as viewed in FIG. 1), so that the bypass am may pivot on pivot shaft 54 independently of pivot arm 60. Collar 62 is provided on pivot shaft 54 so that a first resistance and biasing mechanism, such as spring 66, may be mounted between the frame 67 of machine 20 and collar 62 to provide for limited upward elastic movement of the pivot shaft to minimize the risk of damage or breakage of pivot shaft 54 caused by forces generated during operation of the reducing machine. The weight and placement of pivot arm 60 and compression roller 56 cause the compression roller to urge material on conveyor 22 downwardly and towards rotor 24.

A second resistance and biasing mechanism, such as spring 68, is mounted between the frame of the machine and rear end 70 of bypass arm 52 and adapted to urge the breaker assembly towards rotor assembly 23. Material that is conveyed by input conveyor 22 to rotor assembly 23 will be carried by the rotor into contact with the breaker assembly, where it may be broken into smaller pieces by contact between the short cutting tools on rotor assembly 23 and the leading edges 50 and the upper surfaces 48 of shear blocks 44 and/or by the long cutting tools on the rotor assembly and the leading edges 72 and the outer surfaces 74 of breaker blocks 46. In the embodiments of the invention illustrated in FIGS. 1-5, breaker blocks 46 of the breaker assembly have an outer surface 74 and a leading edge 72 that forms a right angle or an approximate right angle with the outer surface.

As the material is carried past the breaker assembly by the cutting tools on rotor assembly 23, continued rotation of the rotor assembly causes partially reduced material to be further reduced by successive impacts of the cutting tools of the rotor assembly until it will pass through the apertures in one or another of screen sections 76, 78 or 80 and fall onto output conveyor 81 for removal from the machine in the direction indicated by arrow 82. Material that does not pass through any of the screen sections on a first pass may be carried by the cutting tools on the rotor assembly into contact with the breaker assembly again.

Figure 19A:
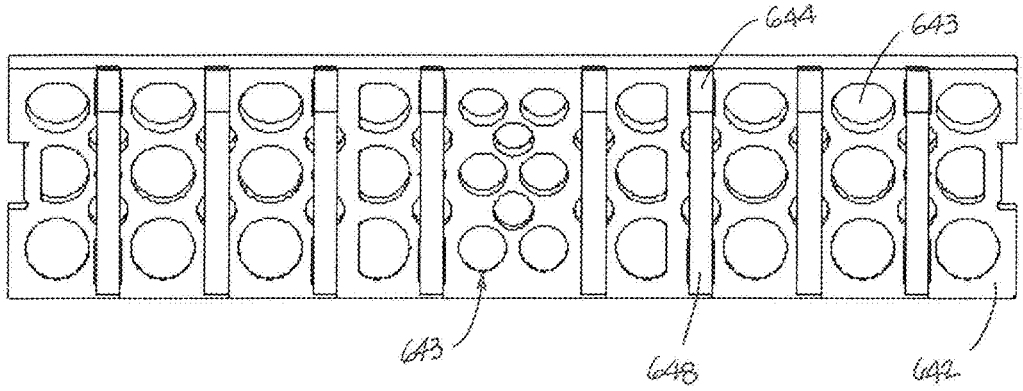
FIG. 19A is a front view of the back plate and shear blocks that comprise a portion of the material reducing machine shown in FIGS. 16 and 17.
Figure 19B:
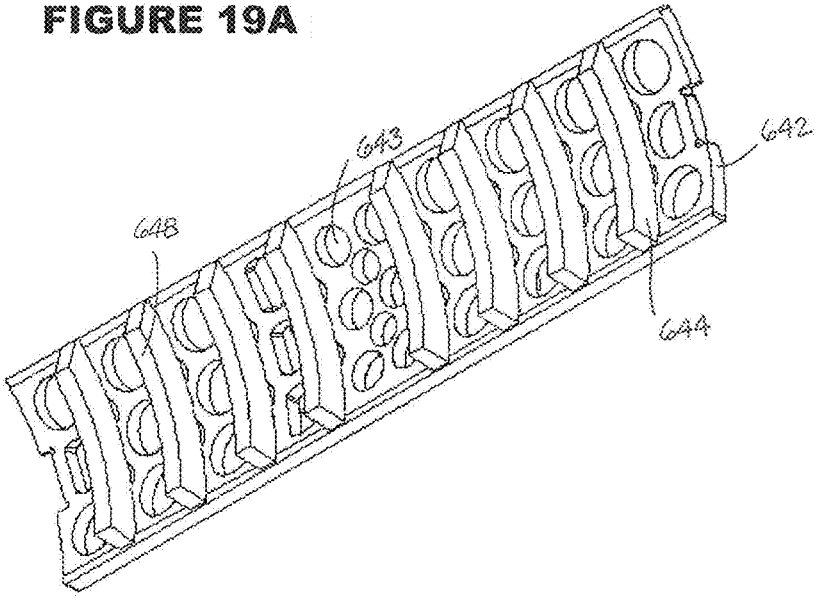
FIG. 19B is a perspective view of the back plate and shear blocks shown in FIG. 19A.

The invention allows for operation of the material reducing machine at a wide range of rotational speeds. More particularly, the rotor assembly of the invention may be rotated about its axis of rotation at a rate within the range of 50-1000 RPM. The lower end of this range is outside the range at which conventional machines can be effectively operated. When the back plate of the invention is provided with apertures through which reduced material may pass (such as is shown in FIGS. 19A and 19B), the invention allows for removal of one or more of screen sections 76, 78 and 80, so that some or all of the reduced material will pass through the apertures in the back plate and fall onto output conveyor 81. However, when some or all of the screen sections are removed, it is desirable that a deflector plate 79 be installed along the length of rotor assembly 23 to deflect reduced material passing through the apertures in the back plate, thereby protecting output conveyor 81, especially when the output conveyor comprises a belt that can be torn or cut by reduced material.

Figure 6:
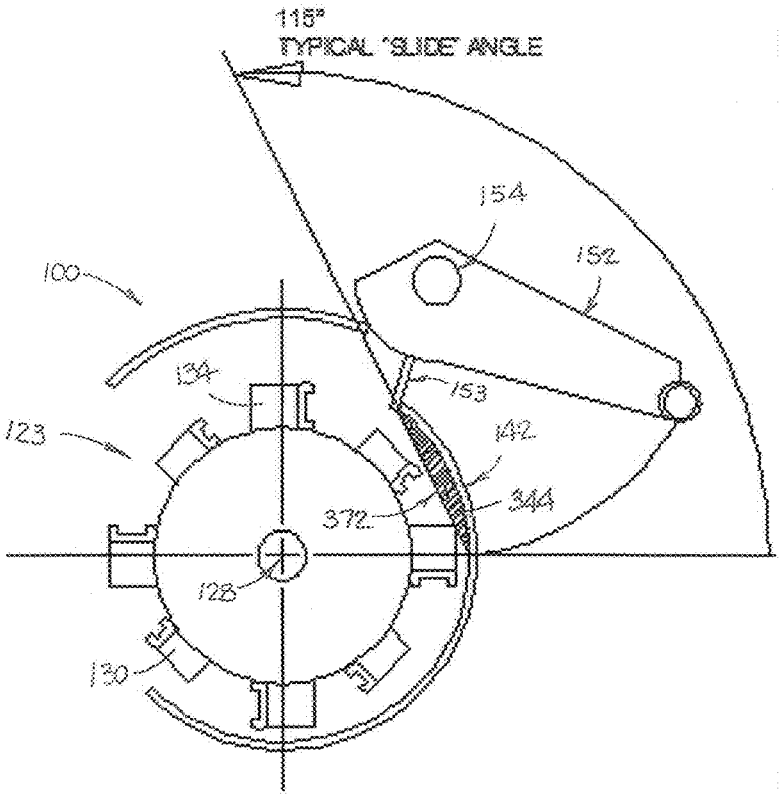
FIG. 6 is a schematic view of a material reducing machine having a breaker assembly with a plurality of shear blocks that are configured to form a preferred slide angle, illustrating the breaker assembly in the closed position.
Figure 7:
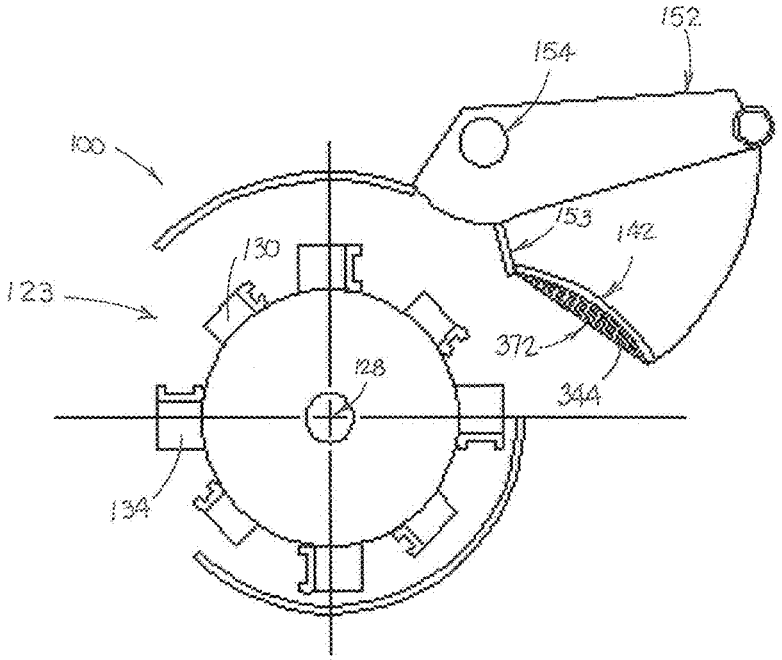
FIG. 7 is a schematic view of a material reducing machine having a breaker assembly with a plurality of shear blocks that are configured to form a preferred slide angle, illustrating the breaker assembly in the open position.

Included within the scope of the invention are shear blocks that can be formed in various configurations depending on the nature of the materials being processed by the material reducing machine, as well as on the operating conditions and parameters of the machine. FIGS. 6 and 7 illustrate a portion of material reducing machine 100 having rotor assembly 123 on which are mounted short cutting tools 130 and long cutting tools 134. Machine 100 also includes a breaker assembly that is located adjacent to the rotor. The breaker assembly includes a curved back plate 142 with a plurality of shear blocks 344 and breaker blocks (not shown) arranged across the width of the machine on the side of back plate 142 adjacent to rotor assembly 123. Shear blocks 344 include a leading surface 372. Each of the shear blocks extends from the back plate towards the rotor assembly a greater distance than the breaker blocks, and the cutting tools on the rotor assembly and the shear blocks and breaker blocks on the back plate are arranged so that the long cutting tools 134 are aligned with the breaker blocks and the short cutting tools 130 are aligned with shear blocks 344. Back plate 142 is a part of bypass arm 152, as is anvil 153, and the bypass arm is adapted to rotate about pivot shaft 154. In the embodiment of the invention illustrated in FIGS. 6 and 7, the leading surfaces of the shear blocks comprise a slide angle of greater than 100°, preferably about 115°, when measured from a horizontal plane that includes the axis 128 of rotation of rotor assembly 123. Shear blocks of this configuration present minimal resistance to the flow of materials within the machine, and they may be employed when it is anticipated that oversized materials are included among easily reducible materials on the input conveyor. When shear blocks including leading surfaces comprising a slide angle are employed and an object that cannot be reduced encounters the breaker assembly, the force of the impact of the object on the breaker assembly, either alone or in combination with the added impact forces imparted to the object by the tools on rotating rotor assembly 123, will cause bypass arm 152 to pivot on pivot shaft 154 from the closed position shown in FIG. 6 to the open position shown in FIG. 7. This will allow the oversized object to fall out of the machine onto the output conveyor. Then, when the oversized object has cleared the breaker bar assembly, the opening force is removed, and a spring (similar to spring 68 of machine 20) may apply a biasing force to move bypass arm 152 from the open position shown in FIG. 7 to the closed position shown in FIG. 6.

Figure 8:
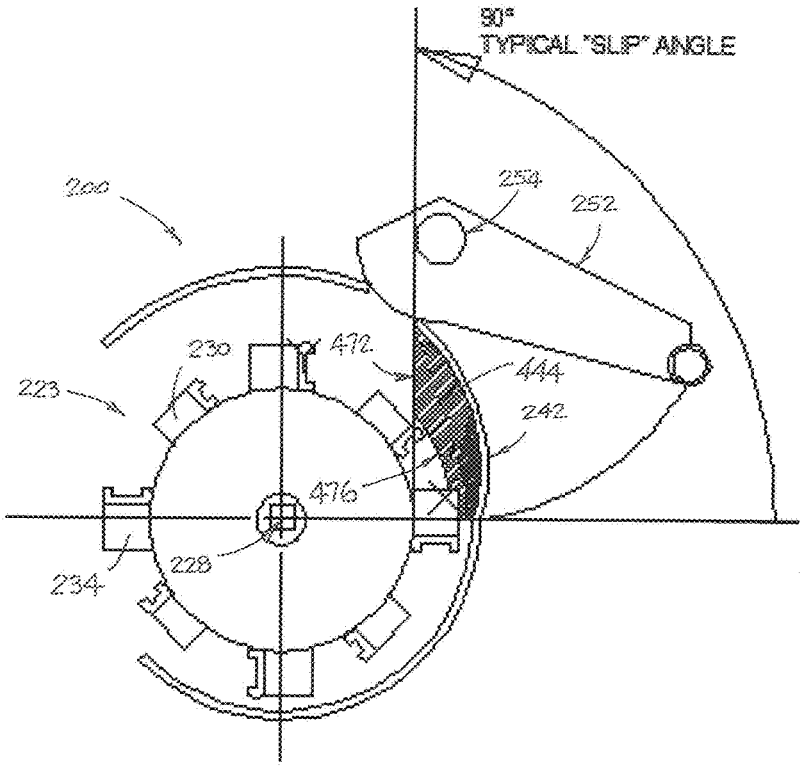
FIG. 8 is a schematic view of a material reducing machine having a breaker assembly with a plurality of shear blocks that are configured to form a preferred slip angle, illustrating the breaker assembly in the closed position.
Figure 9:
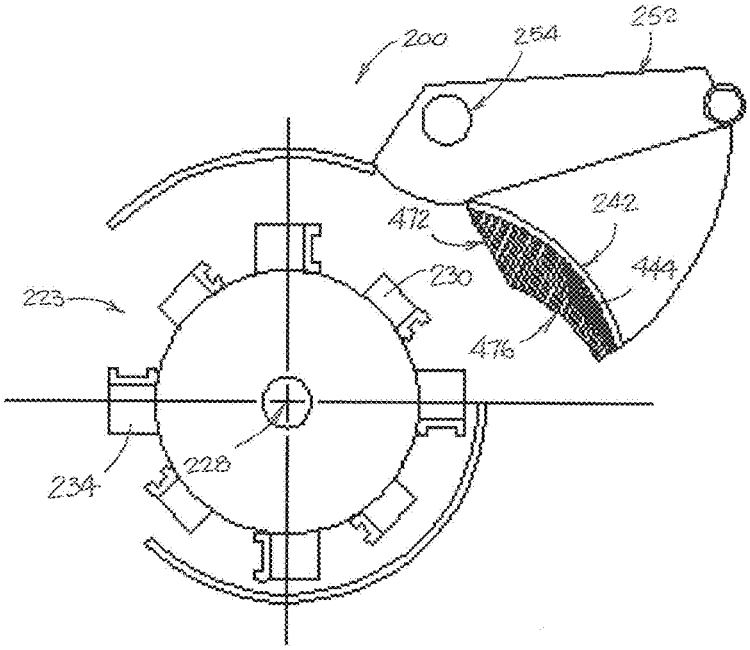
FIG. 9 is a schematic view of a material reducing machine having a breaker assembly with a plurality of shear blocks that that are configured to form a preferred slip angle, illustrating the breaker assembly in the open position.

FIGS. 8 and 9 illustrate a portion of material reducing machine 200 having rotor assembly 223 on which are mounted short cutting tools 230 and long cutting tools 234. Machine 200 also includes a breaker assembly that is located adjacent to the rotor assembly. The breaker assembly includes a curved back plate 242 with a plurality of shear blocks 444 and breaker blocks (not shown) arranged across the width of the machine on the side of back plate 242 adjacent to rotor assembly 223. Each of shear blocks 444 has a leading surface 472 and a trailing surface 476. Shear blocks 444 extend from the back plate towards the rotor a greater distance than the breaker blocks, and the cutting tools on the rotor and the shear blocks and breaker blocks on the back plate are arranged so that the long cutting tools 234 are aligned with the breaker blocks and the short cutting tools 230 are aligned with shear blocks 444. Back plate 242 is a part of bypass arm 252, which is adapted to rotate about pivot shaft 254. In the embodiment of the invention illustrated in FIGS. 8 and 9, the leading surfaces 472 of the shear blocks comprise a slip angle that is within the range of 80°-100°, preferably about 90°, when measured from a horizontal plane that includes the axis 228 of rotation of rotor assembly 223. Shear blocks of this configuration present greater resistance to the flow of materials within the machine than do shear blocks that include leading surfaces that comprise a slide angle, and they may be employed when it is anticipated that a mixture of non-reducible objects and reducible materials will be conveyed towards the rotor on the input conveyor. When shear blocks including leading surfaces that comprise a slip angle are employed and an object that cannot be reduced encounters the breaker assembly, the force of the impact of the object on the breaker assembly, either alone or in combination with the added impact forces imparted to the object by the tools on rotating rotor assembly 223, will cause bypass arm 252 to pivot on pivot shaft 254 from the closed position shown in FIG. 8 to the open position shown in FIG. 9. This will allow the non-reducible object to fall out of the machine onto the output conveyor. Then, when the non-reducible object has cleared the breaker bar assembly, the opening force is removed, and a spring (similar to spring 68 of machine 20) may apply a biasing force to move bypass arm 252 from the open position shown in FIG. 9 to the closed position shown in FIG. 8.

Figure 10:
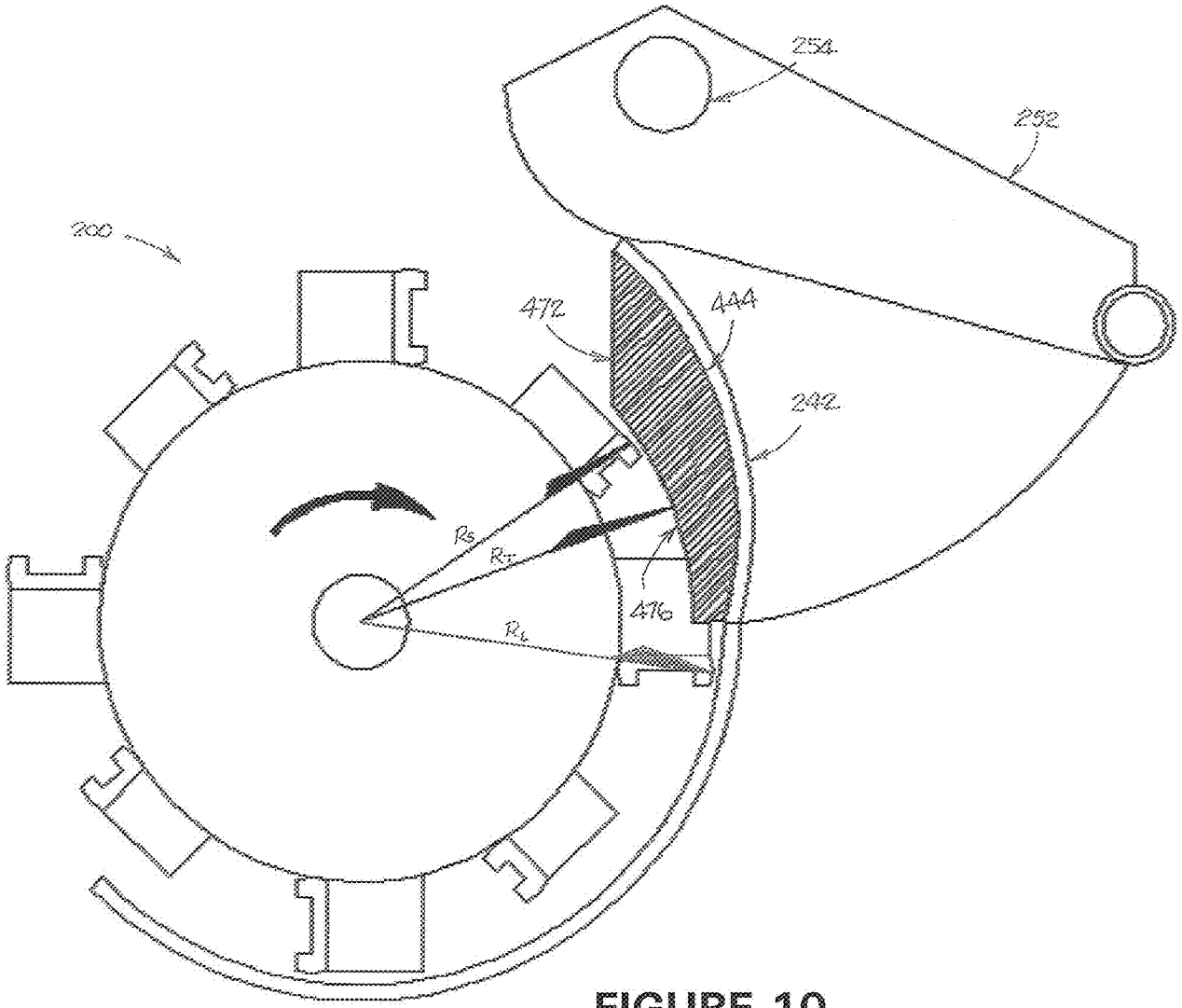
FIG. 10 is a schematic view of a material reducing machine having a breaker assembly with a plurality of shear blocks that that are configured to form a preferred slip angle, showing the inner radius of the shear blocks and the radii of the arcs of rotation of the leading edges of the short and long cutting tools mounted on the rotor assembly.

FIG. 10 illustrates the relationships between the radius $R_T$ of the trailing surface 476 of shear blocks 444, the radius of the arc of rotation of the leading edges of the short cutting tools $R_S$ and the radius of the arc of rotation of the leading edges of the long cutting tools $R_L$ on the rotor assembly. In this embodiment of the invention, $R_S$ is within the range of $0.90R_T$-$0.995R_T$, and $R_L$ is greater than $1.05R_T$. Furthermore, $R_S$ is within the range of $0.5R_L$-$0.9R_L$.

Figure 11:
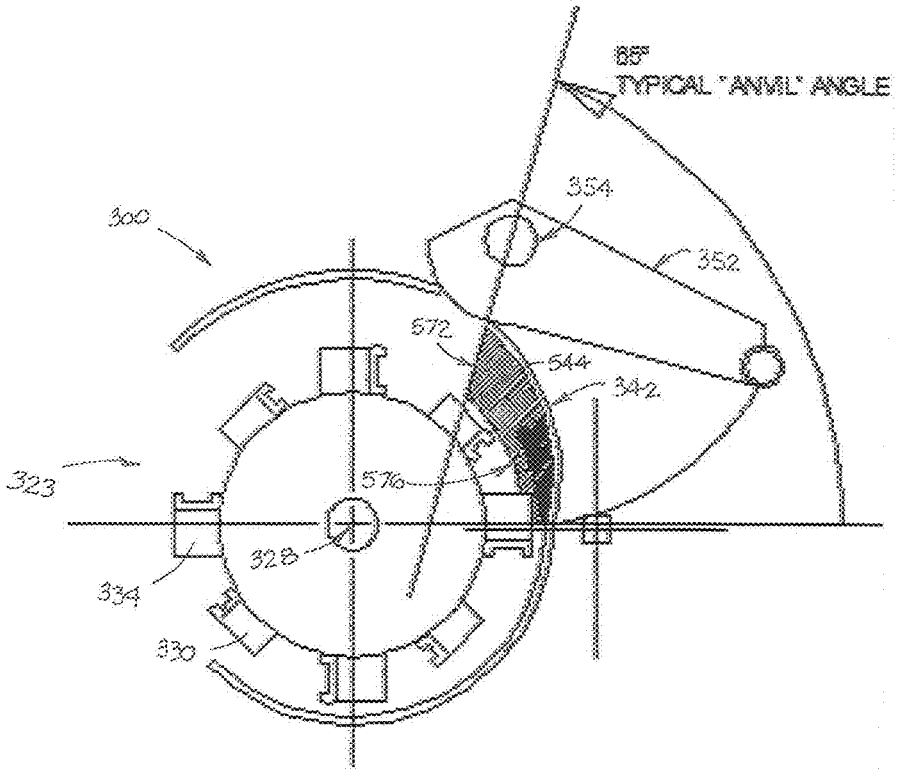
FIG. 11 is a schematic view of a material reducing machine having a breaker assembly with a plurality of shear blocks that that are configured to form a preferred anvil angle, illustrating the breaker assembly in the closed position.
Figure 12:
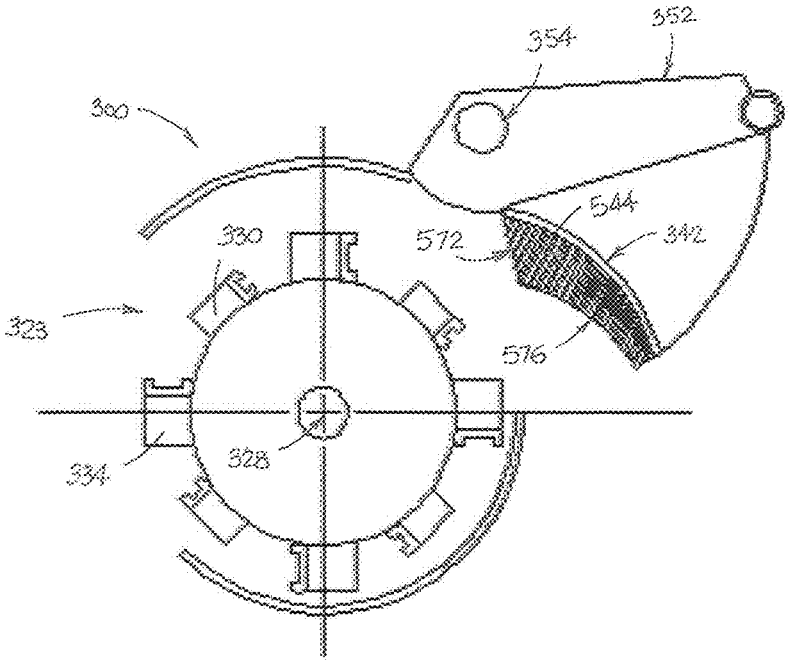
FIG. 12 is a schematic view of a material reducing machine having a breaker assembly with a plurality of shear blocks that that are configured to form a preferred anvil angle, illustrating the breaker assembly in the open position.

FIGS. 11 and 12 illustrate a portion of material reducing machine 300 having rotor assembly 323 on which are mounted short cutting tools 330 and long cutting tools 334. Machine 300 also includes a breaker assembly that is located adjacent to the rotor assembly. The breaker assembly includes a curved back plate 342 with a plurality of shear blocks 544 and breaker blocks (not shown) arranged across the width of the machine on the side of back plate 342 adjacent to rotor assembly 323. Each of shear blocks 544 has a leading surface 572 and a trailing surface 576. Shear blocks 544 extend from the back plate towards the rotor assembly a greater distance than the breaker blocks, and the cutting tools on the rotor assembly and the shear blocks and breaker blocks on the back plate are arranged so that the long cutting tools 334 are aligned with the breaker blocks and the short cutting tools 330 are aligned with shear blocks 544. Back plate 342 is a part of bypass arm 352, which is adapted to rotate about pivot shaft 354. In the embodiment of the invention illustrated in FIGS. 11 and 12, the leading surface of each of the shear blocks comprises an anvil angle that is within the range of 50°-80°, preferably about 65°, when measured from a horizontal plane that includes the axis 328 of rotation of rotor 324. Shear blocks of this configuration present greater resistance to the flow of materials within the machine than do shear blocks having leading surfaces that comprise a slip angle, and they may be employed when it is anticipated that few non-reducible objects will be conveyed towards the rotor on the input conveyor. Shear blocks having leading surfaces that comprise an anvil angle create resistance that is similar to that of conventional anvils in material reducing machines. When shear blocks having leading surfaces comprising an anvil angle are employed and an object that cannot be reduced encounters the breaker assembly, the force of the impact of the object on the breaker assembly, either alone or in combination with the added impact forces imparted to the object by the tools on rotating rotor assembly 323, will cause bypass arm 352 to pivot on pivot shaft 354 from the closed position shown in FIG. 11 to the open position shown in FIG. 12. This will allow the non-reducible object to fall out of the machine onto the output conveyor. Then, when the non-reducible object has cleared the breaker bar assembly, the opening force is removed, and a spring (similar to spring 68 of machine 20) may apply a biasing force to move bypass arm 352 from the open position shown in FIG. 12 to the closed position shown in FIG. 11.

Figure 13:
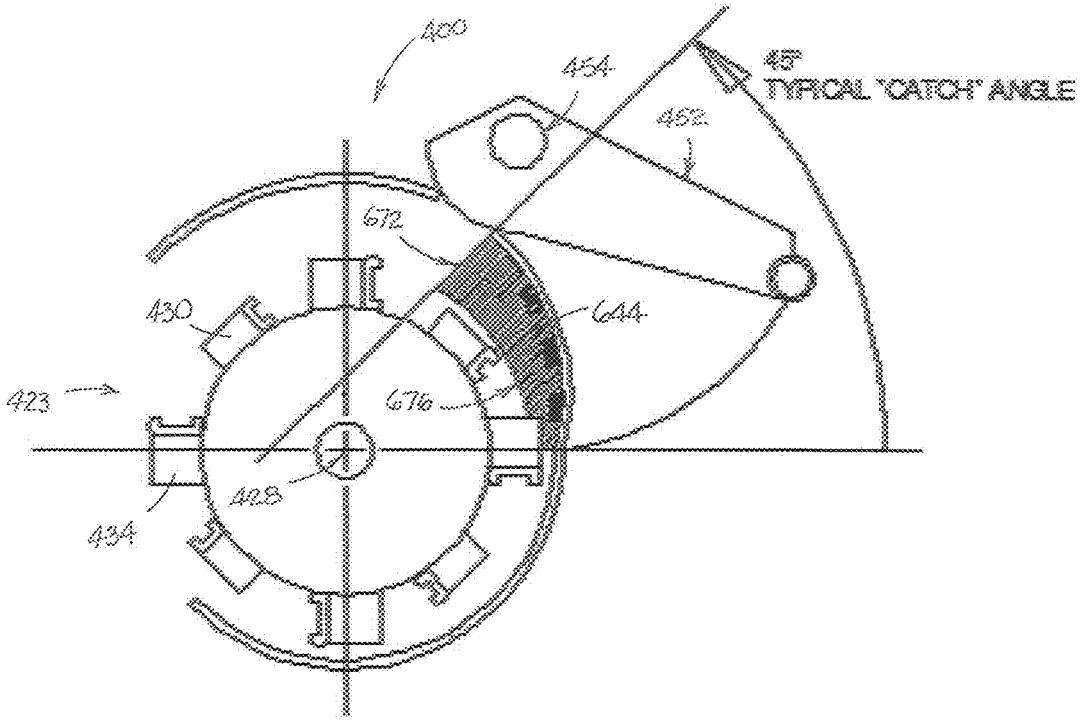
FIG. 13 is a schematic view of a material reducing machine having a breaker assembly with a plurality of shear blocks that that are configured to form a preferred catch angle, illustrating the breaker assembly in the closed position.
Figure 14:
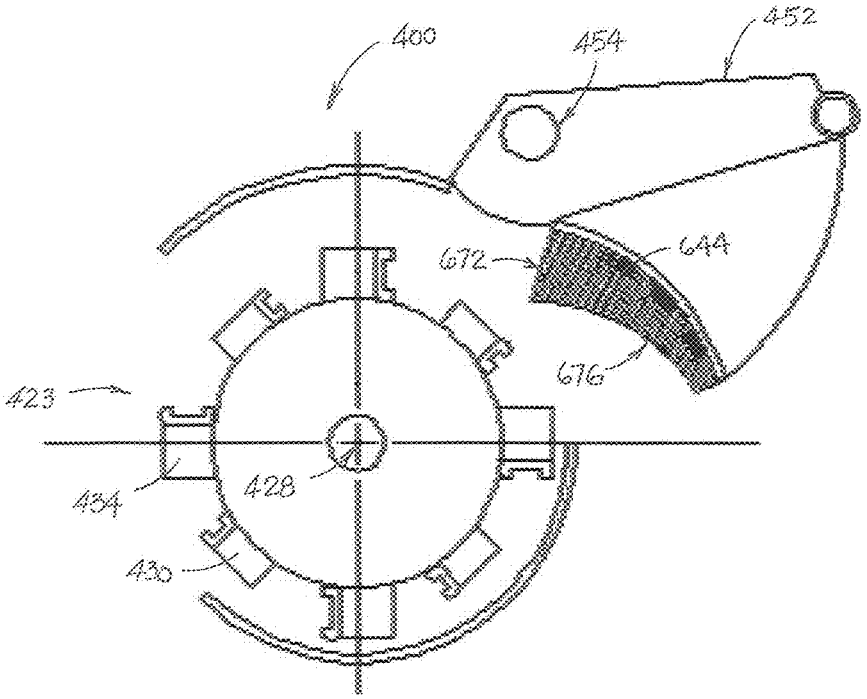
FIG. 14 is a schematic view of a material reducing machine having a breaker assembly with a plurality of shear blocks that that are configured to form a preferred catch angle, illustrating the breaker assembly in the open position.

FIGS. 13 and 14 illustrate a portion of material reducing machine 400 having rotor assembly 423 on which are mounted short cutting tools 430 and long cutting tools 434. Machine 400 also includes a breaker assembly that is located adjacent to the rotor assembly. The breaker assembly includes a curved back plate 442 with a plurality of shear blocks 644 and breaker blocks (not shown) arranged across the width of the machine on the side of back plate 442 adjacent to rotor assembly 423. Each of shear blocks 644 has a leading surface 672 and a trailing surface 676. Shear blocks 644 extend from the back plate towards the rotor assembly a greater distance than the breaker blocks, and the cutting tools on the rotor assembly and the shear blocks and breaker blocks on the back plate are arranged so that the long cutting tools 434 are aligned with the breaker blocks and the short cutting tools 430 are aligned with shear blocks 644. Back plate 442 is a part of bypass arm 452, which is adapted to rotate about pivot shaft 454. In the embodiment of the invention illustrated in FIGS. 13 and 14, shear blocks 644 have a leading surface 672 that comprises a catch angle that is within the range of 40°-50°, preferably about 45°, when measured from a horizontal plane that includes the axis 428 of rotation of rotor assembly 423. Shear blocks of this configuration present greater resistance to the flow of materials within the machine than do shear blocks having leading surfaces that comprise an anvil angle, and they may be employed when it is anticipated that only small non-reducible objects will be conveyed towards the rotor on the input conveyor. When shear blocks having leading surfaces comprising a catch angle are employed and an object that cannot be reduced encounters the breaker assembly, the force of the impact of the object on the breaker assembly, either alone or in combination with the added impact forces imparted to the object by the tools on rotating rotor assembly 423, will cause bypass arm 452 to pivot on pivot shaft 454 from the closed position shown in FIG. 13 to the open position shown in FIG. 14. This will allow the non-reducible object to fall out of the machine onto the output conveyor. Then, when the non-reducible object has cleared the breaker bar assembly, the opening force is removed, and a spring (similar to spring 68 of machine 20) may apply a biasing force to move bypass arm 452 from the open position shown in FIG. 14 to the closed position shown in FIG. 13.

Figure 15:
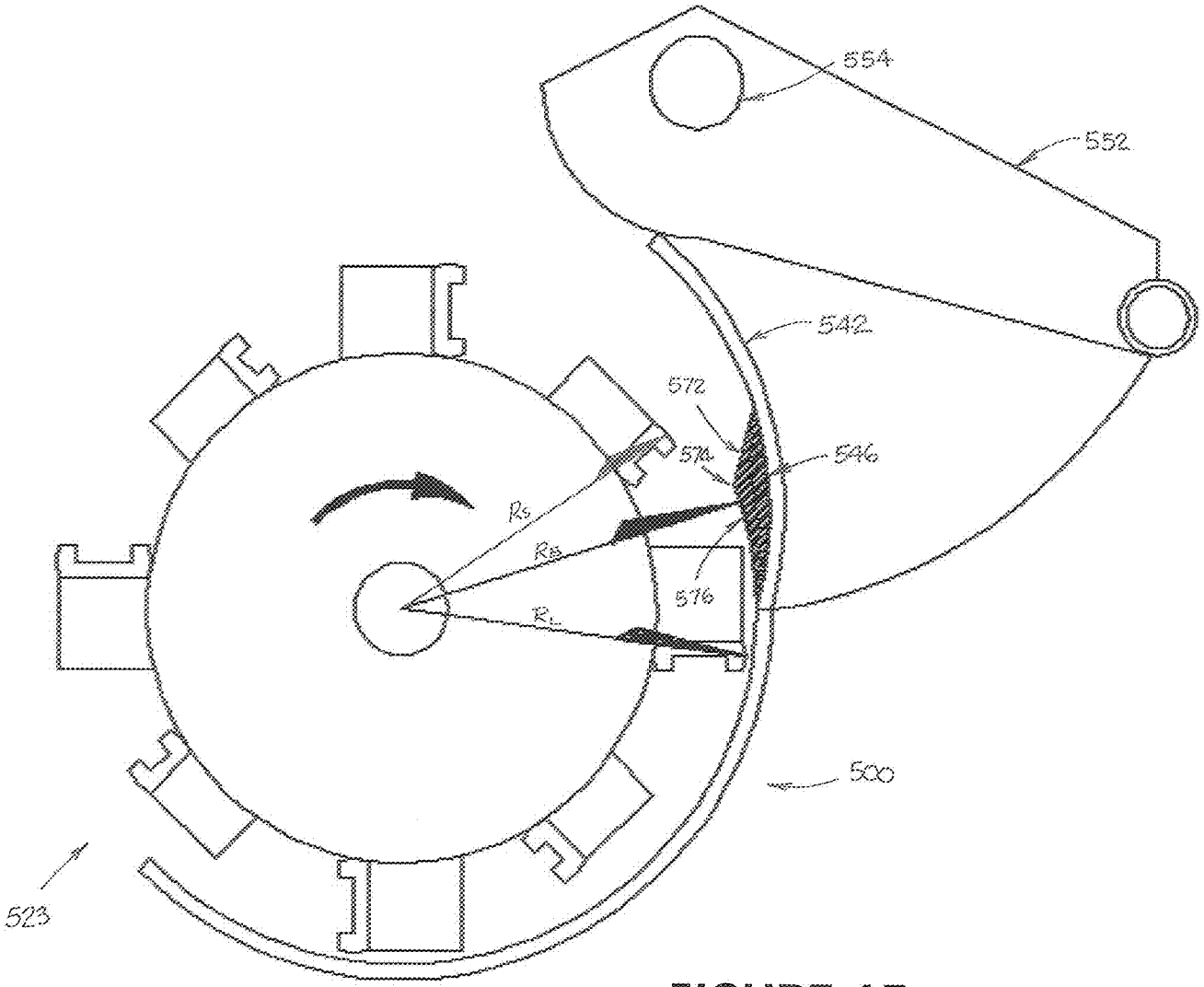
FIG. 15 is a schematic view of a material reducing machine having a breaker assembly with a plurality of breaker blocks that have a leading surface which gradually increases to a point of maximum outward projection from the back plate and a trailing surface that gradually decreases from the point of maximum outward projection, showing the inner radius of the breaker blocks and the radii of the arcs of rotation of the leading edges of the short and long cutting tools mounted on the rotor assembly.

FIG. 15 illustrates a portion of material reducing machine 500 having rotor assembly 523 on which are mounted short cutting tools and long cutting tools. Machine 500 also includes a breaker assembly that is located adjacent to the rotor assembly. The breaker assembly includes a curved back plate 542 with a plurality of shear blocks (not shown) and breaker blocks 546 arranged across the width of the machine on the side of back plate 542 adjacent to rotor assembly 523. The shear blocks extend from the back plate towards the rotor assembly a greater distance than breaker blocks 546, and the cutting tools on the rotor assembly and the shear blocks and breaker blocks on the back plate are arranged so that the long cutting tools are aligned with breaker blocks 546 and the short cutting tools are aligned with the shear blocks. Back plate 542 is a part of bypass arm 552, which is adapted to rotate about pivot shaft 554. Each of breaker blocks 546 has a leading surface 572 that gradually increases to a point 574 of maximum outward projection from the back plate and a trailing surface 576 that gradually decreases from the point of maximum outward projection to the back plate. FIG. 15 also illustrates the relationships between the radius $R_B$ of the trailing surface 576 of the breaker blocks, the radius of the arc of rotation of the leading edges of the short cutting tools $R_S$ and the radius of the arc of rotation of the leading edges of the long cutting tools $R_L$ on the rotor. In this embodiment of the invention, $R_S$ is less than $0.90R_B$, and $R_L$ is within the range of $0.9R_B$-$0.995R_B$.

Figure 16:
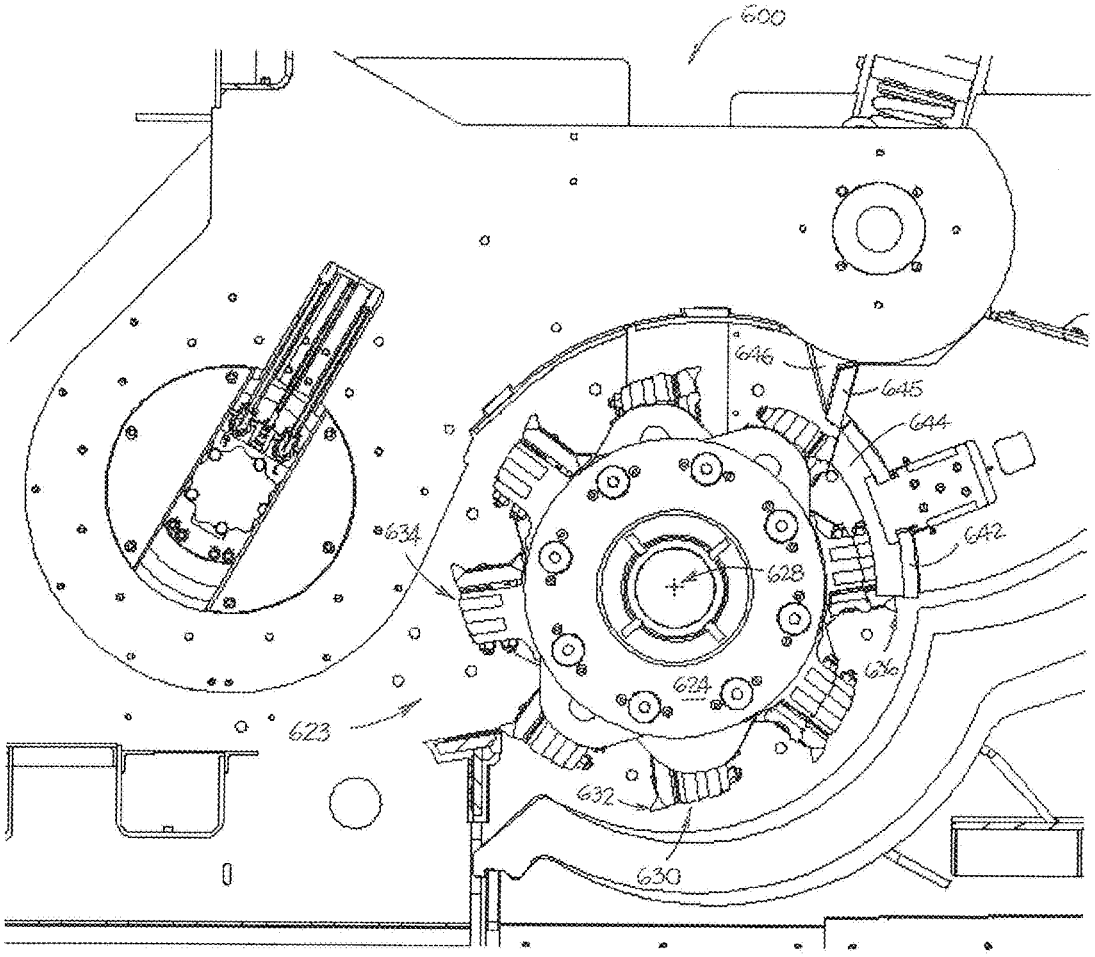
FIG. 16 is a schematic illustration of a material reducing machine, including a breaker assembly comprising a plurality of shear blocks, each of which is attached to the back plate, and each of which comprises an inner surface that is curved to describe an arc that is generally parallel to the arc described by the cutting bit of the short cutting tool with which it is aligned, and an anvil to which a plurality of breaker blocks are attached.
Figure 17:
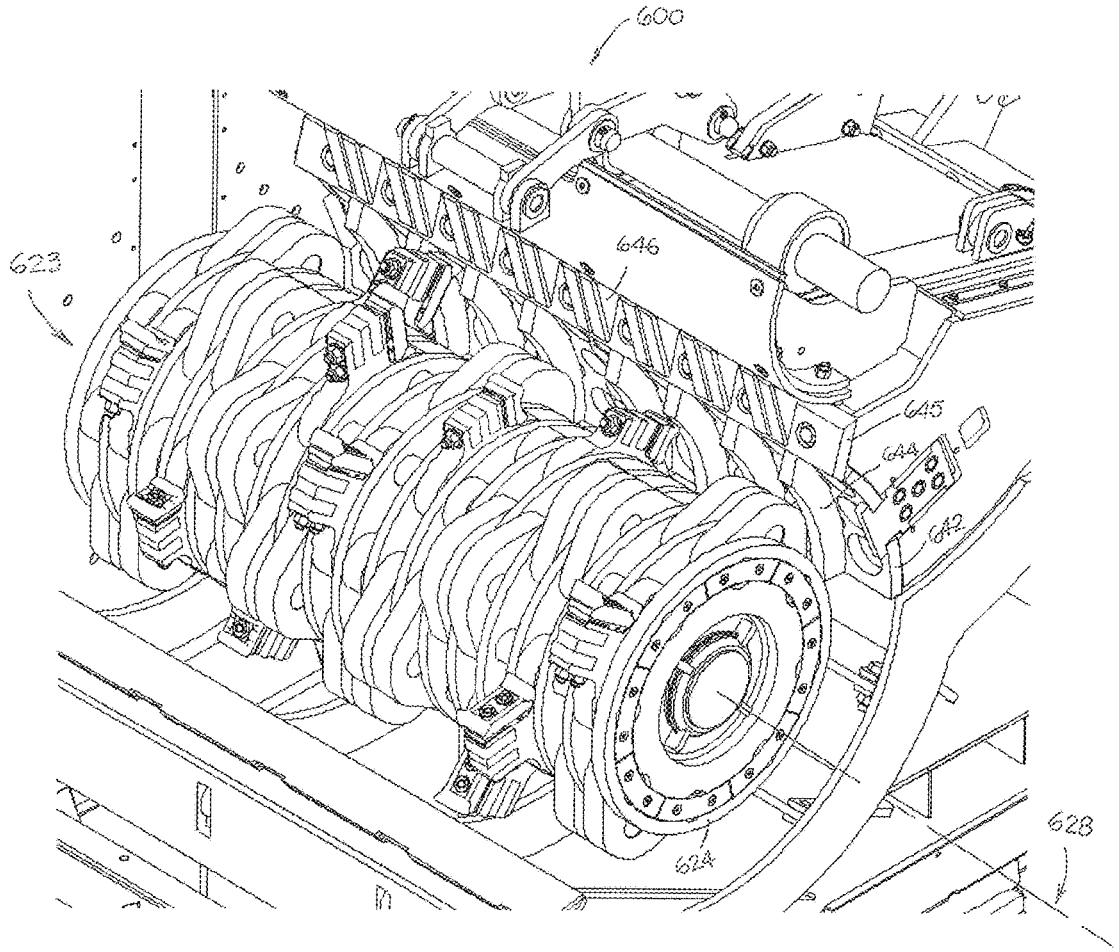
FIG. 17 is a perspective view of a portion of the material reducing machine shown in FIG. 16.
Figure 18A:
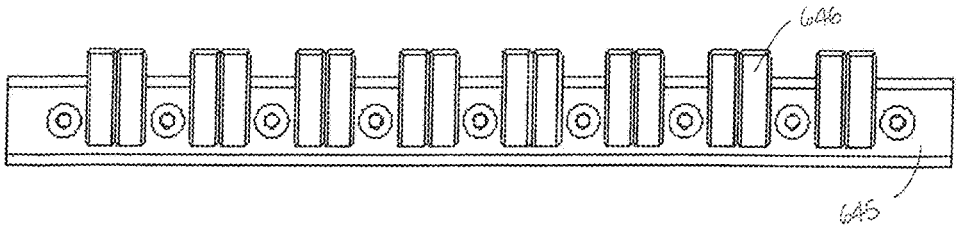
FIG. 18A is a front view of the anvil assembly that comprises a portion of the material reducing machine shown in FIGS. 16 and 17.
Figure 18B:
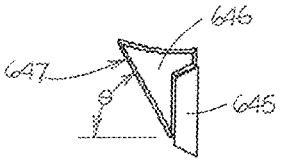
FIG. 18B is a side view of the anvil assembly shown in FIG. 18A.
Figure 18C:
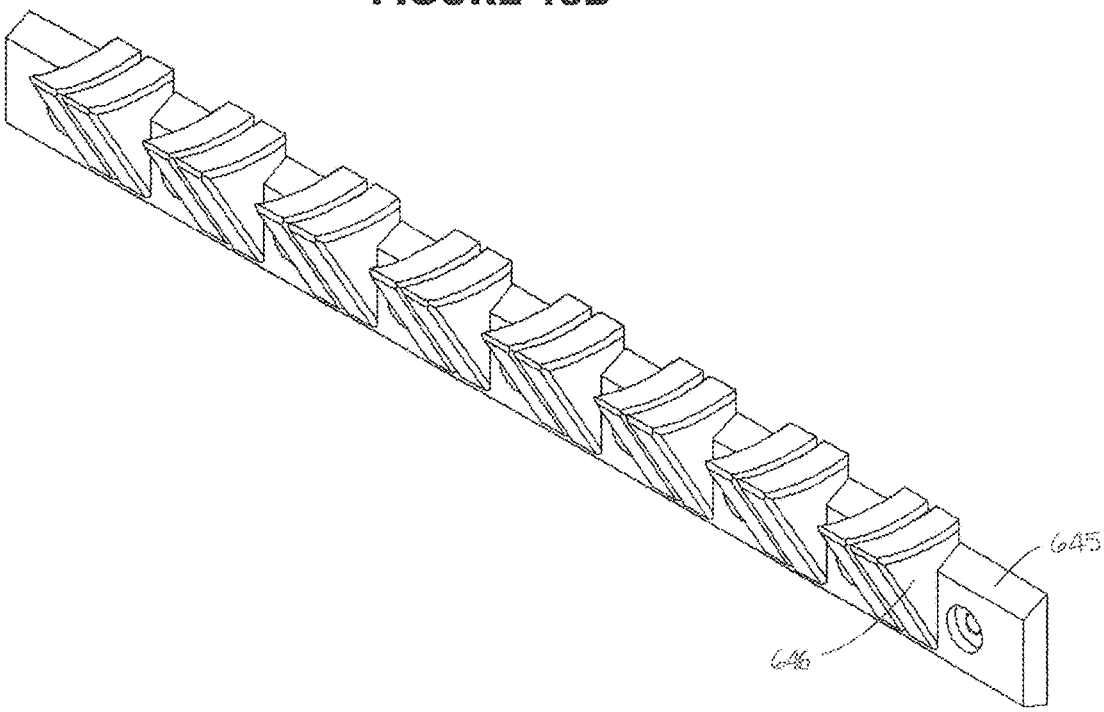
FIG. 18C is a perspective view of the anvil assembly shown in FIGS. 18A and 18B.

FIGS. 16-19B illustrate a portion of material reducing machine 600 having rotor assembly 623 on which are mounted short cutting tools 630 and long cutting tools 634. Rotor assembly 623 comprises a plurality of generally circular rotor plates (shown in FIG. 17), one of which, plate 624, is also shown in FIG. 16. Rotor assembly 623 is adapted to rotate in a clockwise direction, as shown in FIG. 16, about its axis of rotation 628. Short cutting tools 630 and long cutting tools 634 are arranged in rows that extend across the length of the rotor assembly (i.e., across the width of the frame of the machine), and rows of cutting tools are spaced around the periphery of the rotor assembly so that as the rotor assembly is rotated, the tools carry material from conveyor into engagement with a breaker assembly that is located adjacent to the rotor assembly. The leading edges of cutting bits 632 of the short cutting tools 630 mounted on rotor assembly 623 define an arc that is spaced outwardly from the periphery of rotor assembly 623 by a short cutter distance. Similarly, the leading edges of cutting bits 636 of the long cutting tools 634 mounted on rotor assembly 623 define an arc that is spaced outwardly from the periphery of the rotor assembly by a long cutter distance which is greater than the short cutter distance. As shown in FIGS. 16 and 17, it is preferred that the short cutting tools be arranged in rows that are parallel to axis of rotation 628, which rows extend all the way across the length of the rotor assembly. Similarly, it is preferred that the long cutting tools be arranged in rows that are parallel to the axis of rotation, which rows extend all the way across the length of the rotor assembly. It is also preferred that alternating rows of short cutting tools and long cutting tools be spaced around the periphery of the rotor assembly.

Material reducing machine 600 also includes a breaker assembly that is located adjacent to the rotor assembly. The breaker assembly includes anvil 645 (also shown in FIGS. 18A-18C) and a plurality of breaker blocks 646 arranged across the width of the machine on the side of anvil 645 adjacent to rotor assembly 623. Each of these breaker blocks has a leading surface 647 that forms an angle θ that is within the range of 30°-75°, preferably about 60°, when measured from a horizontal plane that includes the axis of rotation 628 of the rotor assembly. The breaker assembly of this embodiment of the invention also includes curved back plate 642 (also shown in FIGS. 19A and 19B), which is provided with a plurality of apertures 643 (best shown in FIGS. 19A and 19B) through which reduced material may pass. A plurality of shear blocks 644 are arranged across the width of the machine on the side of back plate 642 adjacent to rotor assembly 623. The shear blocks extend from the back plate towards the rotor assembly a greater distance than the breaker blocks, and the cutting tools on the rotor assembly and the shear blocks and breaker blocks on the back plate are arranged so that the long cutting tools 634 are aligned with breaker blocks 646 and the short cutting tools 630 are aligned with shear blocks 644. Each of shear blocks 644 has a curved outer surface 648 that is parallel to the arc described by the leading edge of the cutting bit 632 of the short cutting tool 630 with which it is aligned. It is preferred that the cutting tools of rotor assembly 623 and the shear blocks 644 and breaker blocks 646 of the breaker assembly are arranged so that at least one short cutting tool 630 passes over a shear block 644 with which it is aligned, and at least one long cutting tool 634 passes between a pair of adjacent shear blocks 644 and over the breaker block 646 with which it is aligned. More particularly, as shown in FIG. 16, the short cutting tools 630 and the long cutting tools 634 are spaced along the length of the rotor assembly 623, and the shear blocks 644 and the breaker blocks 646 are spaced along the back plate 642 in such a manner that all of the short cutting tools pass over the curved outer surfaces 648 of shear blocks 644, and the long cutting tools pass between adjacent shear blocks 664 and over the breaker blocks 646. The components of the breaker assembly of this configuration allow the machine to be operated with more "release" action but with less stress. This permits the rotor assembly to be rotated at a rate within the range of 50-1000 RPM, which includes rates that are too slow for efficient operation of conventional machines. Operating the machine at the low end of this range reduces fuel consumption, wear and noise levels.

Although this description contains many specifics, these should not be construed as limiting the scope of the invention but as merely providing illustrations of the presently preferred embodiments thereof, as well as the best mode contemplated by the inventors of carrying out the invention. The invention, as described herein, is susceptible to various modifications and adaptations, as would be understood by those having ordinary skill in the art to which the invention relates.

What is claimed is:

1. A material reducing machine comprising:

(a) a frame;

(b) a rotor assembly which is mounted for rotation about an axis of rotation with respect to the frame, said rotor assembly comprising:

(i) a periphery;

(ii) a length;

(iii) a plurality of short cutting tools that are arranged in rows which extend across the length of the rotor assembly, with a plurality of rows being spaced around the periphery of the rotor assembly, wherein each of the short cutting tools comprises a cutting bit with a leading edge that:

(A) is spaced outwardly from the periphery of the rotor assembly by a short cutter distance;

(B) describes an arc as the rotor assembly is rotated with respect to the frame;

(iv) a plurality of long cutting tools that are arranged in rows which extend across the length of the rotor assembly, with a plurality of rows being spaced around the periphery of the rotor assembly, wherein each of the long cutting tools comprises a cutting bit with a leading edge that is spaced outwardly from the periphery of the rotor assembly by a long cutter distance that is greater than the short cutter distance of each of the short cutting tools;

(c) means for rotating the rotor assembly with respect to the frame in a rotational direction;

(d) a material input device for conveying material to be reduced towards the rotor assembly, said material input device being arranged so that the short cutting tools and the long cutting tools on the rotor assembly make initial contact with material to be reduced in an upward direction;

(e) a breaker assembly that is located adjacent to the rotor assembly, said breaker assembly being located so that as the rotor assembly is rotated in the rotational direction, the short cutting tools and long cutting tools will carry material from the material input device upwardly and into engagement with the breaker assembly, said breaker assembly further comprising:

(i) a back plate;

(ii) a plurality of shear blocks, each of which:

(A) is spaced so as to be aligned with a short cutting tool;

(B) has an outer surface that is curved to describe an arc that is parallel to the arc described by the leading edge of the cutting bit of the short cutting tool with which it is aligned.

2. The material reducing machine of claim 1, wherein a plurality of rows of long cutting tools are spaced around the periphery of the rotor assembly so as to be separated from the plurality of rows of short cutting tools.

3. The material reducing machine of claim 1, wherein the plurality of shear blocks are mounted on the back plate.

4. The material reducing machine of claim 1, wherein each of the shear blocks has a leading edge selected from the group consisting of beveled leading edges, angled leading edges and flat leading edges.

5. The material reducing machine of claim 1, wherein the curved outer surface of each of the shear blocks is interrupted by notches or grooves.

6. The material reducing machine of claim 1, wherein the leading surface of each of the shear blocks comprises a slide angle of greater than 100°, when measured from a horizontal plane that includes the axis of rotation of the rotor assembly.

7. The material reducing machine of claim 1, wherein the leading surface of each of the shear blocks comprises a slip angle that is within the range of 80°-100°, when measured from a horizontal plane that includes the axis of rotation of the rotor assembly.

8. The material reducing machine of claim 1, wherein the leading surface of each of the shear blocks comprises an anvil angle that is within the range of 50°-80°, when measured from a horizontal plane that includes the axis of rotation of the rotor assembly.

9. The material reducing machine of claim 1, wherein the leading surface of each of the shear blocks comprises a catch angle that is within the range of 40°-50°, when measured from a horizontal plane that includes the axis of rotation of the rotor assembly.

10. The material reducing machine of claim 1, which includes:

(a) a pivot arm carrying a compression roller;

(b) a bypass arm on which the breaker assembly is mounted, which bypass arm carries a resistance and biasing mechanism that is provided between the frame and a pivot shaft on which the pivot arm carrying the compression roller and the bypass arm carrying the breaker assembly are mounted;

(c) a resistance and biasing mechanism between the frame and the bypass arm.

11. The material reducing machine of claim 1, wherein:

(a) a shear block has a trailing surface having a radius with respect to the axis of rotation of the rotor assembly;

(b) the leading edge of the cutting bit of the short cutting tool aligned with the shear block describes an arc of rotation as the rotor assembly is rotated about its axis of rotation, which arc of rotation is within the range of 0.90-0.995 of the radius of the trailing surface of the shear block.

12. The material reducing machine of claim 1, wherein:

(a) a shear block has a trailing surface having a radius with respect to the axis of rotation of the rotor assembly;

(b) the leading edge of the cutting bit of a long cutting tool that is adjacent to the shear block describes an arc of rotation as the rotor assembly is rotated about its axis of rotation, which arc of rotation is greater than 1.05 of the radius of the trailing surface of the shear block.

13. The material reducing machine of claim 1, wherein the radius of the arc of rotation described by the leading edge of a cutting bit of a short cutting tool is within the range of 0.5-0.9 of the radius of the arc of rotation described by the leading edge of the cutting bit of an adjacent long cutting tool.

14. The material reducing machine of claim 1, which is adapted to be operated at a rate of rotation of the rotor assembly within the range of 50-1000 RPM.

15. The material reducing machine of claim 1:

(a) wherein the back plate of the breaker assembly includes apertures through which material may pass;

(b) which includes an output conveyor for removing reduced material that is located below the rotor assembly;

(c) which includes a deflector plate that is located below the breaker assembly and is arranged so that material passing through the apertures in the back plate will strike the deflector plate before falling onto the output conveyor.

16. The material reducing machine of claim 1, wherein the breaker assembly includes a plurality of breaker blocks, each of which is spaced so as to be aligned with a long cutting tool.

17. The material reducing machine of claim 16, wherein the cutting tools of the rotor assembly and the shear blocks and breaker blocks of the breaker assembly are arranged so that at least one short cutting tool passes over the shear block with which it is aligned, and at least one long cutting tool passes between a pair of adjacent shear blocks and over the breaker block with which it is aligned.

18. The material reducing machine of claim 16, wherein each of the breaker blocks has an outer surface and a leading edge that forms a right angle with the outer surface.

19. The material reducing machine of claim 16, wherein:

(a) each of the breaker blocks is mounted on the back plate;

(b) each of the breaker blocks has a leading surface that gradually increases to a point of maximum outward projection from the back plate and a trailing surface that gradually decreases from the point of maximum outward projection;

(c) the radius of the arc of rotation described by the leading edges of the cutting bits of the short cutting tools is less than 0.90 of the radius of the trailing surface of each of the breaker blocks;

(d) the radius of the arc of rotation described by the leading edges of the cutting bits of the long cutting tools is within the range of 0.90-0.995 of the radius of the trailing surface of each of the breaker blocks.

20. The material reducing machine of claim 16:

(a) which includes an anvil;

(b) wherein each of the breaker blocks is attached to the anvil;

(c) wherein each of the breaker blocks has a leading surface that forms an angle that is within the range of 30°-75°, when measured from a horizontal plane that includes the axis of rotation of the rotor assembly.

* * * * *